US005279496A

United States Patent [19]

Schroeder

[11] Patent Number: 5,279,496

[45] Date of Patent: Jan. 18, 1994

[54] DIRECT MOUNT TELESCOPIC ADJUSTABLE BACKBOARD

[75] Inventor: Edward Schroeder, Marengo, Ill.

[73] Assignee: Porter Athletic Equipment Company, Broadview, Ill.

[21] Appl. No.: 950,674

[22] Filed: Sep. 25, 1992

[51] Int. Cl.[5] ..... A63B 63/08

[52] U.S. Cl. ..... 273/1.5 R; 248/219.4; 248/230

[58] Field of Search ..... 273/1.5 R; 248/230, 248/539, 219.4, 274

[56] References Cited

U.S. PATENT DOCUMENTS

| | | | |
|---|---|---|---|
| 2,916,288 | 12/1959 | Chervenka | 273/1.5 R |
| 3,251,570 | 5/1966 | Frost et al. | 248/230 X |
| 3,964,743 | 6/1976 | Salsich, Sr. | 273/1.5 R |
| 3,970,304 | 7/1976 | Ebstein et al. | 273/1.5 R |
| 4,395,040 | 7/1983 | White | 273/1.5 R |
| 4,500,064 | 2/1985 | Calabro | 248/539 |
| 4,643,422 | 2/1987 | Cramblett | 273/1.5 R |
| 4,781,375 | 11/1988 | Nye | 273/1.5 R |
| 4,798,381 | 1/1989 | Dadbeh | 273/1.5 R |
| 4,941,661 | 7/1990 | Lykens | 273/1.5 R |
| 4,948,127 | 8/1990 | Willard | 273/1.5 R |
| 5,114,141 | 5/1992 | Mahoney | 273/1.5 R |

FOREIGN PATENT DOCUMENTS

| | | | |
|---|---|---|---|
| 826546 | 1/1938 | France | 248/230 |

*Primary Examiner*—Paul E. Shapiro
*Attorney, Agent, or Firm*—Barnes & Thornburg

[57] ABSTRACT

An adjustable structure wherein the rim is mounted directly to a center bracket and a slide through or under the backboard. A support bracket having vertical and horizontal walls with apertures in each wall to receive fasteners to mount the adjustable structure to single or dual, horizontal or vertical support struts and systems.

14 Claims, 6 Drawing Sheets

DIRECT MOUNT TELESCOPIC ADJUSTABLE BACKBOARD

TECHNICAL FIELD

The present invention relates generally to adjustable backboards and rims and more specifically to direct mount, telescopic adjustable basketball backboard and rim structures.

BACKGROUND ART

In the art of adjustable backboards and rims, a typical example is the use of a parallelogram connected between a support structure and the backboard and rim combination. The height of the backboard and rim is adjustable and locked in place. Various mechanisms have been used for the drive and the locking mechanisms. These generally have fallen in the categories of screw and bolt mechanisms, and rachet mechanisms. Although the parallelogram with the rachet mechanism has been very popular in the consumer market, the institutional market has different requirements. A parallelogram takes up valuable space because of the distance required from the support structure. Similarly, institutional backboards and rims are substantially heavier than consumer backboards and rims and therefore require a more substantial structure than a cantilevered parallelogram structure.

In the institutional market, the backboard and rim is usually supported in one of two ways, namely a single center strut or a pair of double struts. The struts are usually attached to the walls or ceilings of a building. The backboard structure is connected to the pair of struts by two pairs of clamps per strut. For ceiling mount of the structures, the pair of struts generally have a ladder configuration. For a center strut configuration, two vertically spaced brackets, connected to the backboard structure, connect the backboard to a single center strut. Adjustable structures to the single and double struts have been used in the prior art. The double strut structure includes a pair of guides, one connected to each of the double struts, and a pair of slides to which the backboard structure is connected. A horizontal bar connected between the slides and a second horizontal bar extending between the pair of guides are interconnected by a screw drive with a bolt on one of the horizontal bars. The guides and slides have generally the same horizontal displacement as the double struts and the attachment structure of the backboard. A typical example is illustrated in FIG. 1.

For single center strut structure, the guide and slide structure mimic that of the double strut system. A square or partial ladder guide structure is connected to the center strut and the slide structure is connected by a pair of struts to the backboard structure. A screw drive extends between horizontal portions of the guide to the slide structure. A typical example is illustrated in FIG. 2.

Because of the pressure applied to the rim during a slam dunk, there are many designs to protect the backboard from these forces. This is especially true for glass backboards. In non-adjustable backboards, the rim has generally been mounted to the support structures generally through the backboard. This transfers the forces directly to the support structure and not to the backboard. For a center strut, the backboard is mounted directly to the center strut and the rim is mounted to the center strut through the backboard. In a double strut, various vertical bars connecting the two struts have supported the backboard. Other structures have included connecting the rim to the backboard mounting structure either through the backboard or underneath the backboard. While transferring the force to the framing of the backboard, it does not provide the same protection or transfer forces as where the rim is mounted to the support structure instead of the backboard structure. In prior art adjustable backboards, the rim is mounted to the backboard structure and not to the strut supports directly.

DISCLOSURE OF THE INVENTION

Thus it is the object of the present invention to provide an adjustable backboard structure with a direct goal mount.

Another object of the present invention is to provide an improved adjustable backboard structure to be used with direct and indirect goal mounts.

An even further object of the present invention is to provide an adjustable backboard structure which is capable of being used with any of the following: single strut, dual strut, vertical or horizontal struts and support structures.

These and other objects are achieved by mounting the rim through or below the backboard directly to a slide of a telescopic adjustable system. The backboard is also mounted to the slide. The slide slides along a guide which is mounted to a support mounting device. A drive, for example, a screw, positions the slide along the guide to adjust the height of the rim and backboard. A center bracket is connected directly to the slide and has apertures for receiving the fasteners to mount the rim thereto. Lateral brackets, connected to the center bracket, has apertures that receive the fasteners to mount the backboard thereto. The slide includes a pair of slides each connected adjacent a respective edge of the center bracket and the guide includes a pair of guides connected adjacent a respective edge of one or a pair of vertically spaced support brackets. The support brackets each include a vertical portion or horizontal portion. The horizontal and vertical portions each includes one or more apertures for receiving fasteners to mount a horizontal and a vertical support structure.

The adjustable basketball backboard and rim structure may also include a pair of vertical space support brackets for mounting the structure to a support and guides connected to and extending between the pair of support brackets. A center bracket is connected directly to a slide and includes apertures for receiving fasteners to mount a rim to the slide. Lateral brackets connected to the center bracket includes apertures for mounting the backboard to the slide. The drive, for example, a screw, is used to position the slide along the guide to adjust the height of the rim. The slide includes a pair of slides connected adjacent with respect to the edge of the center bracket and the guide includes a pair of guides connected adjacent to the respective edge of the support brackets. The support bracket has the vertical and horizontal portions to receive horizontal and vertical supports.

Adjustable basketball backboard and rim structure may include a pair of vertically spaced support brackets for mounting the structure to a support. The support brackets each include a vertical portion and a horizontal portion, each having one or more apertures for receiving fasteners to mount a horizontal or vertical support.

A guide is connected to the support brackets and a slide is slide mounted to the guide. The backboard mounting structure and rim mounting structure are connected to the slide. A driver, for example a screw, positions the slide along the guide to adjust the height of the rim.

Other objects, advantages and novel features of the present invention will become apparent from the following detailed description of the invention when considered in conjunction with the accompanying drawings.

BEST MODES FOR CARRYING OUT THE INVENTION

Figure 1:
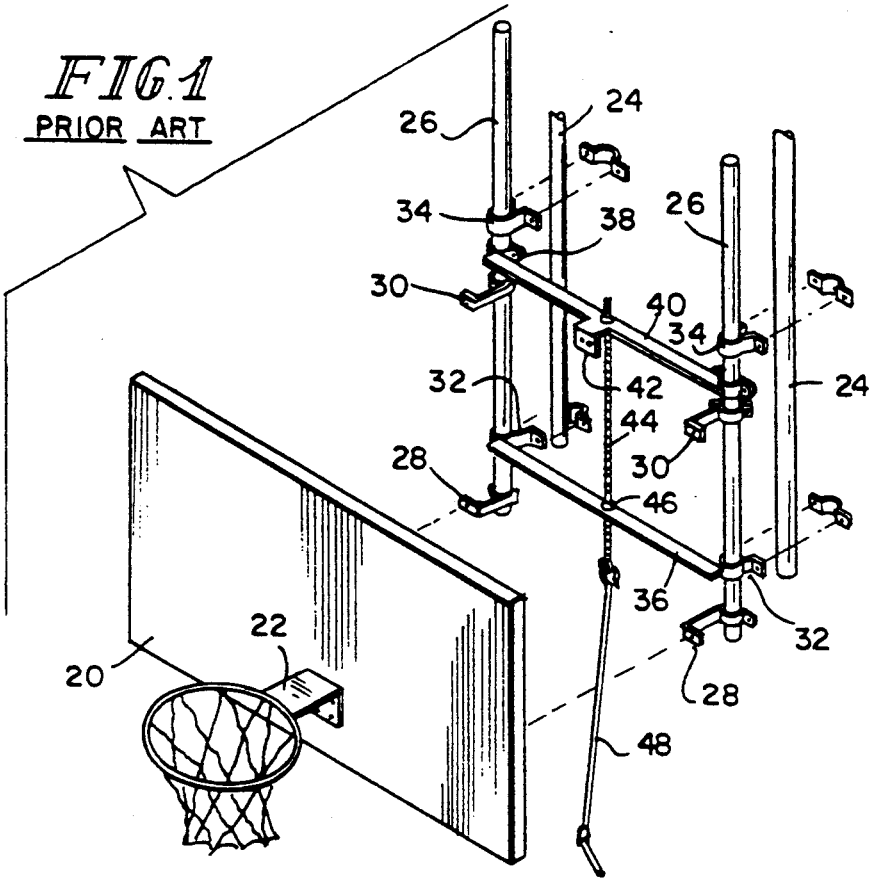
FIG. 1 PRIOR ART
FIG. 1 is a exploded perspective view of a double strut adjustable backboard system of a prior art.

The prior art adjustment structure of FIG. 1 shows a backboard 20 with a rim 22 mounted thereto. A pair of spaced support struts 24 shown are generally mounted to the ceiling. Between the backboard 20 and the support struts 24 are a pair of guides 26 which are connected to the backboard structure by bottom clamps 28 and top clamps 30. In a nonadjustable structure, clamps 28 and 30 would mount the backboard to the pair of struts 24. A bottom pair of clamps 32 and the top pair of clamps 34 are mounted to the struts 24 and include integral therewith guides encompassing the slides 26. An L-shaped horizontal bar 36 extends between the lower slides 32. A pair of clamps 38 mount an L-shaped horizontal bar 40 to the slides 26 and include an L-bracket 42 for mounting to the top of the backboard 20. Screw 44 extends between the horizontal bars 36 and 40 with a nut 46 connected to the lower bar 36. A crank 48 turns the screw 44 to adjust the bars 36 and 40 relative to each other and thereby move the slides 26 with respect to the guides 32 and 34. The rim 22 is mounted to backboard structure or frame through the backboard 20.

Figure 2:
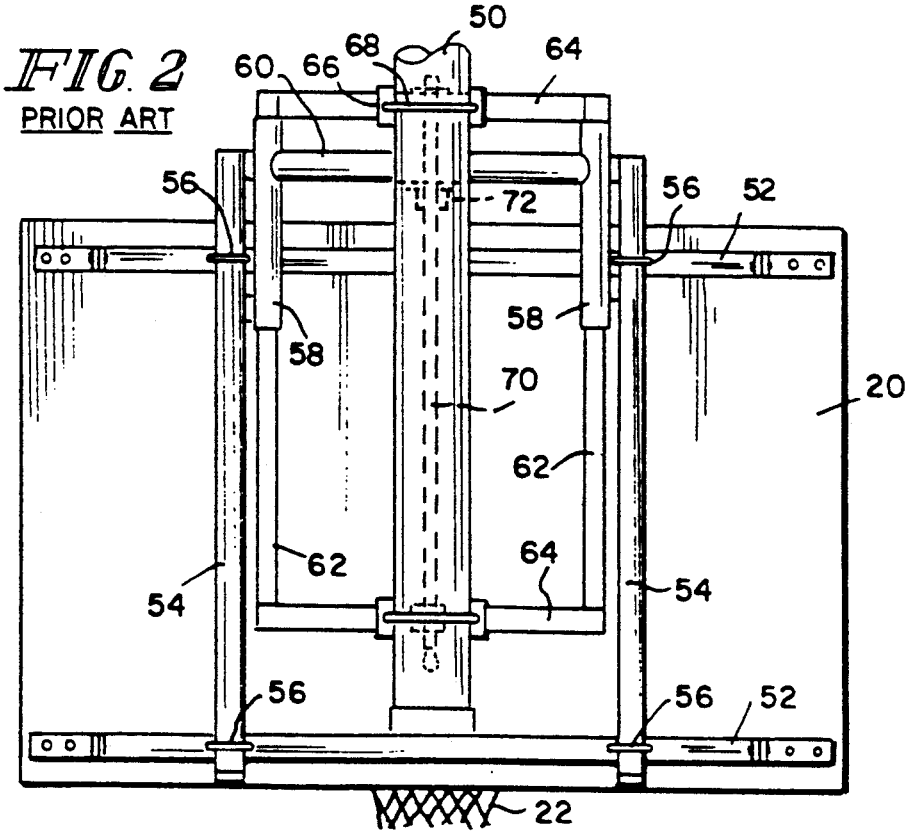
FIG. 2 PRIOR ART
FIG. 2 is a front view of a single center strut adjustable backboard mounting system of a prior art.

The single structure of the prior art as illustrated in FIG. 2 includes a center strut 50. A pair of lateral supports 52 are connected to the backboard structure and are connected to a pair of vertical members 54 by U-bolts 56. Spacing of the members 54 are equivalent to the double structure of FIG. 1, namely elements 24 and 26. Vertical elements 54 are connected, for example by welding to a pair of slides 58. A vertical cross-bar 60 interconnects the guides 58. A pair of vertical guides 62 are interconnected at their opposite ends by horizontal elements 64. A pair of mounting brackets 66 are mounted to the horizontal elements 64 and are connected to the single strut 50 by U-bolts 68. A drive screw 70 extends through the three horizontal elements 60 and 64. The nut 72 is mounted to horizontal element 60 of the guide. Generally the rim 22 is mounted to the backboard structure or frame.

Figure 3:
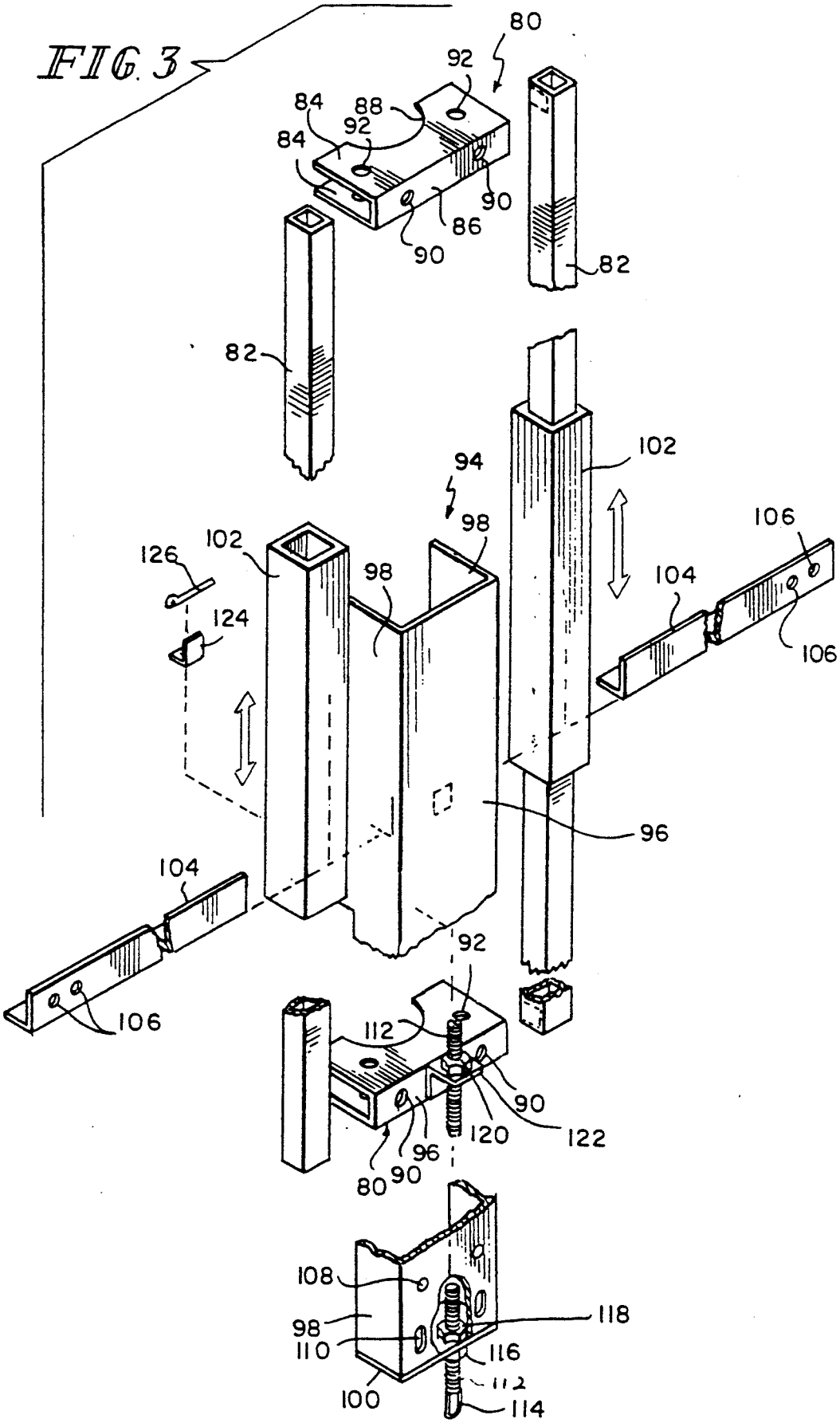
FIG. 3 is a exploded view of the adjustable mechanism prior to assembly incorporating the principles of the present invention.

An adjustable backboard structure of the present invention is illustrated in FIG. 3 in an exploded condition. A pair of support brackets 80 are interconnected by a pair of guides 82, by for example welding it to the lateral faces. The welding areas are illustrated by the dotted lines, for example those on the right guide 82. The support brackets 80 are generally U-shaped having a pair of opposed horizontal walls 84 connected by a vertical wall 86. A curved surface 88 in the horizontal walls 84 receive a circular center strut, for example strut 50 of FIG. 2. The vertical wall 86 includes a pair of apertures 90 to receive a fastener, for example a U-bolt which would connect the support bracket 80 to a single strut. The structure of the support bracket 80 described so far is that generally found in the prior art. As a modification of the prior art bracket 80, a pair of apertures 92 are provided in the two horizontal walls 84. As will be discussed with respect to the FIGS. 7 and 8, this allows the mounting of the complete adjustment structure to horizontal and vertical support structures including double vertical strut structures. Thus, even though the present adjustment system is designed for a single center strut, it may be used with a variety of support structures to be discussed below.

The guide and backboard structure includes a single center bracket 94 being generally U-shaped and having a pair of opposed legs or side walls 98 connected by a rear wall 96. A bottom wall 100 is connected to the side walls 98 and the rear wall 96. A pair of slides 102 are connected adjacent to the edges of the center bracket 94. As illustrated by the dotted lines on the guides 102, the edges of the side walls 98 are butt welded to a face of the slides 102. The slides 102 are telescopically received on the guides 82. A pair of lateral brackets 104 extend from the center bracket 94 and are also butt welded to the exterior of the side walls 98. Apertures 106 provided in the lateral brackets 104 receive fasteners to mount the backboard to the center bracket 96 and the slides 102. The back wall 96 of the center bracket 94 includes a pair of upper apertures 108 and elongated bottom apertures 110 to receive the fasteners of a basketball rim. This allows the connection of the rim directly to the center bracket 94 and the slides 102 through the backboard. This transfers stresses on the rim directly to the slide structure 102 and protects the backboard. These stresses are not transferred to the backboard through the backboard mounting structure, framing structure or any other structure.

The drive mechanism which moves the slides 102 on the guides 82 include a screw mechanism 112 including a loop 114 to receive a crank or other hand manipulating device. The screw 112 is received in bearings 116 and 118 mounted to opposite sides of the bottom wall 110 of the center bracket 94. The screw 112 is then received in a nut 120 mounted to an L-shaped bracket 122 which is welded to wall 86 of bottom mounting bracket 80. Finally, the end of the screw 112 is received in a bracket 124 welded to the inside of the rear wall 96 and a cotter pin 126 is received in the end of the screw 112.

Figure 5:
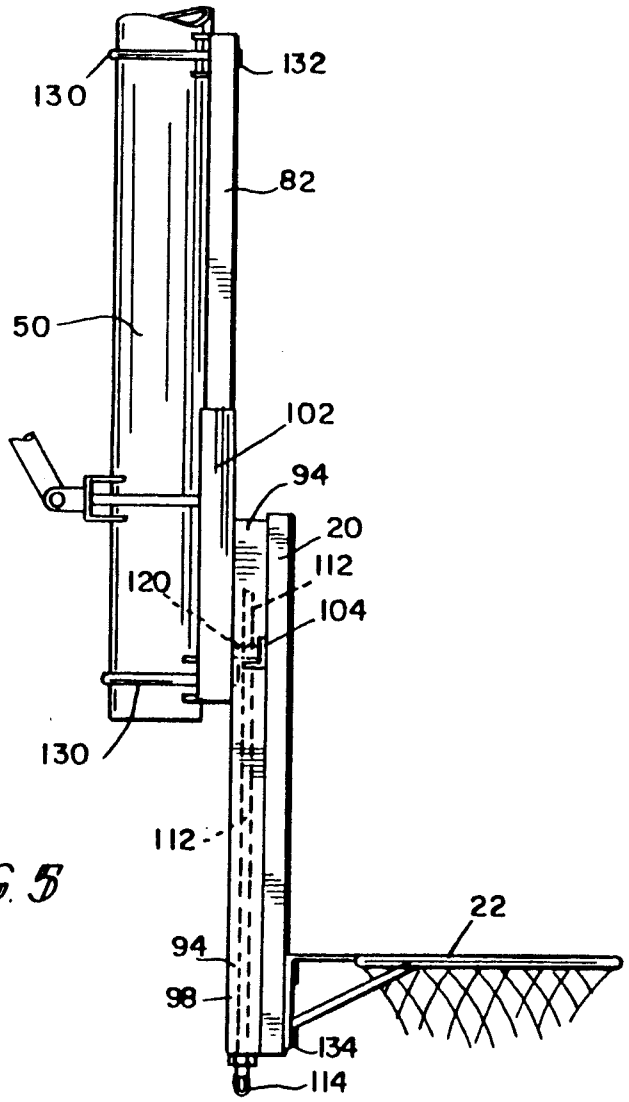
FIGS. 4 and 5 show an adjustable backboard mounted to a single center strut in a raised and lowered position respectively incorporating the principles of the present invention.
Figure 4:
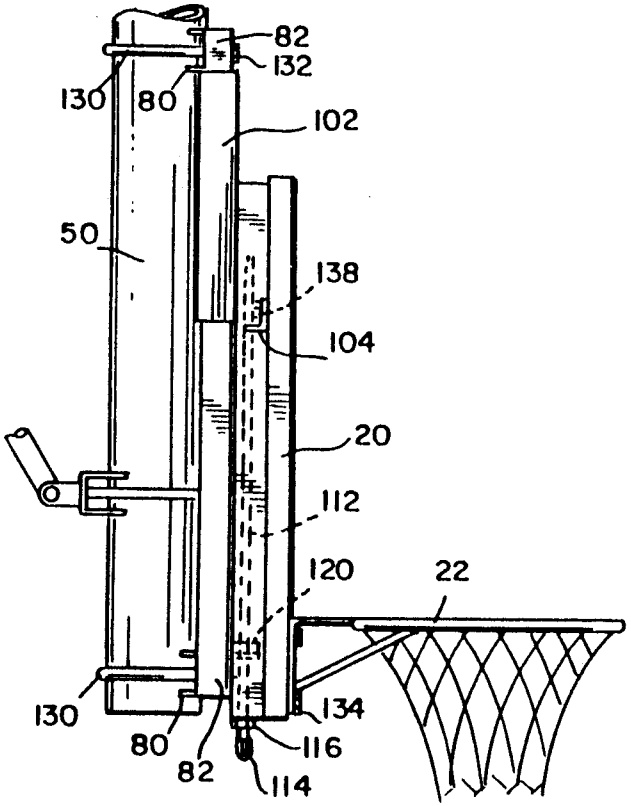
Figure 6:
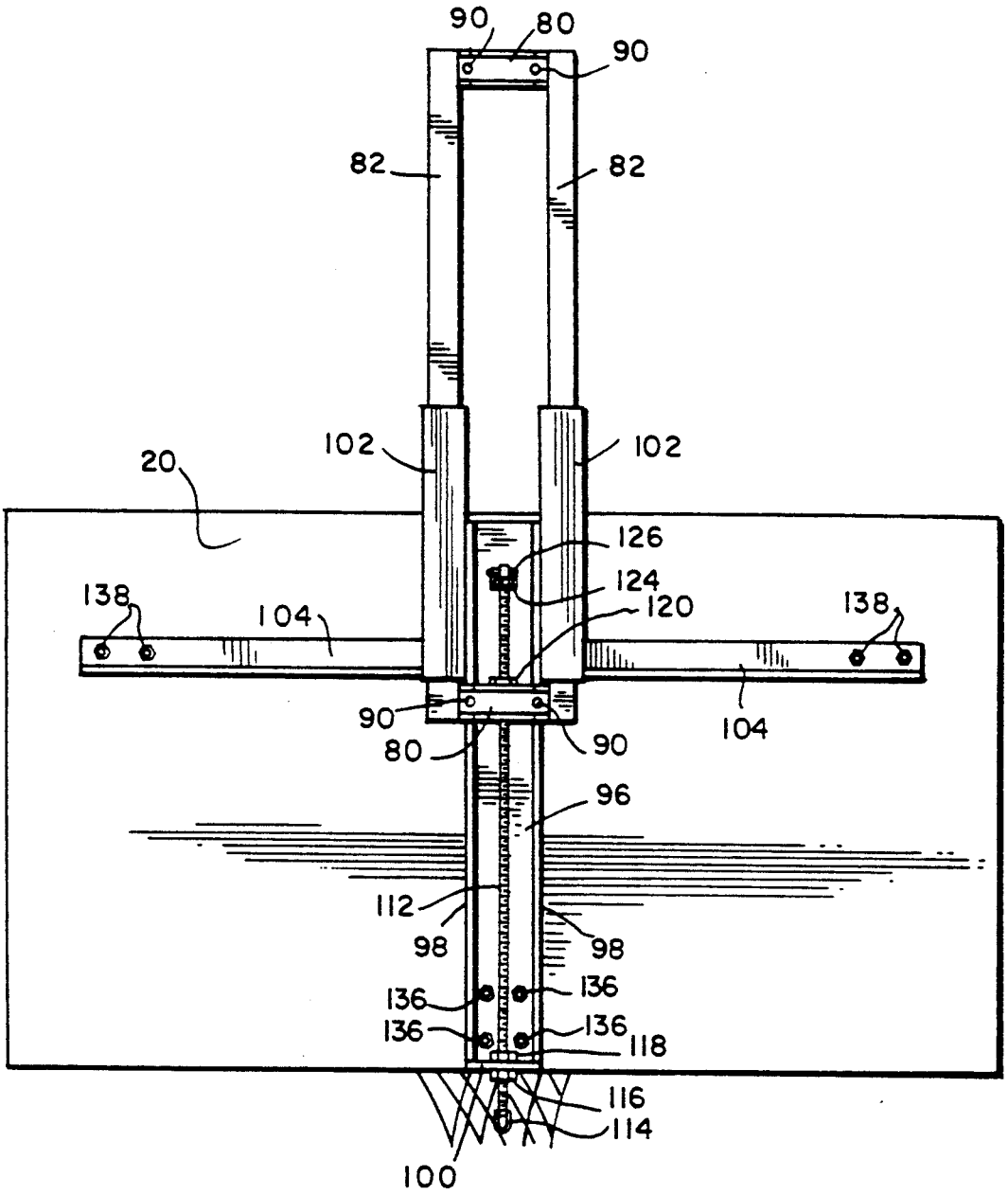
FIG. 6 is a rear view of FIG. 5.

The mounting of the adjustment system to a single center strut 50 is illustrated in FIGS. 4 through 6, with the center strut 50 deleted from FIG. 6 for the sake of clarity. A pair of U-bolts 130 are received in apertures 90 of the brackets in the vertical wall 86 of the top and bottom brackets 80 and secured by nuts 132. The rim 22 is mounted through the backboard 20 to the rear wall 96 of the center bracket 94 by fasteners 134 and nuts 136. The structure to protect the backboard for a through board mounting system is well known in the prior art. The rim is normally mounted to a static structure in a nonadjustable system and is not mounted to the support structure on an adjustable goal system. In the prior art, the goal has generally been mounted to the backboard, backboard frame or backboard mounting structure. This does not isolate the forces on the rim from the backboard or backboard structure. Fasteners 138 receive in apertures 106 in lateral brackets 104 mount the backboard through the lateral and center brackets to the slide 102. The backboard and rim at the ten foot level is illustrated in FIG. 4 and at the eight foot level is illustrated in FIGS. 5 and 6.

Figure 7:
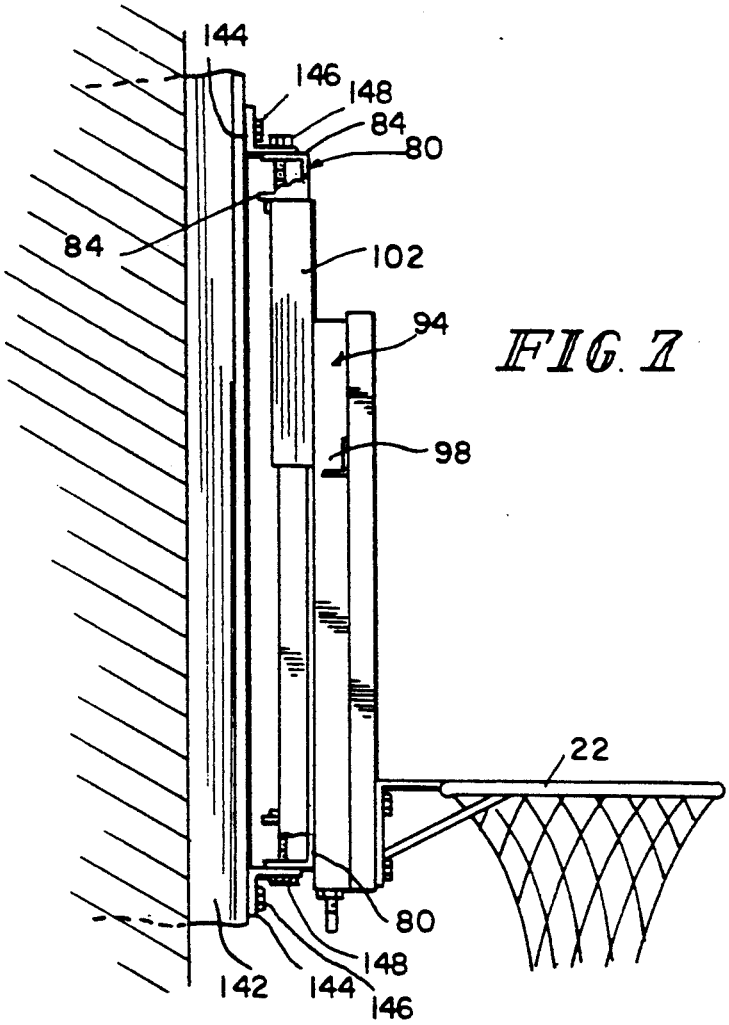
FIG. 7 is a side view of the adjustable mechanism of the present invention mounted to a wall or column.

Although the present system has been designed to be mounted to a single center strut, it may also be mounted to various other structures. As illustrated in FIG. 7, a wall mount may include a wall 140 having a I-beam 142 therein. An L-bracket 144 would then be mounted to the I-beam 142 by a fastener 146. The L-bracket 144 would then be connected by a fastener 148 to the top and bottom brackets 80 by extending through the apertures 92 in the two horizontal walls 84 of the bracket 80.

Figure 8:
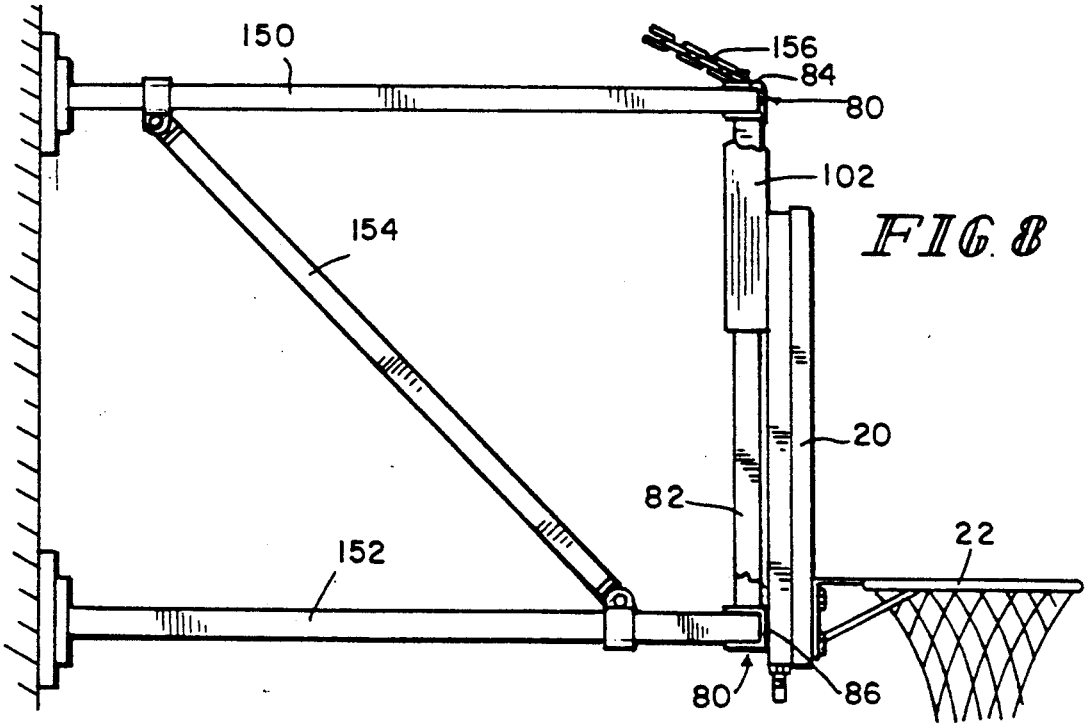
FIG. 8 is a side view of the mechanism according to the present invention mounted at an extended wall mount.

An extended wall mount structure having a pair of upper struts 150 and a single lower strut 152 interconnected by diagonal struts 154 is illustrated in FIG. 8. A support chain 156 is also provided. The single lower strut 152 is connected to the pair of apertures 90 in the vertical wall 86 of the bottom bracket 80. The pair of upper struts 150 are individually attached to the top bracket 80 by fasteners extending through opposed openings 92 in the horizontal walls 84 of the top bracket 80. The support chains 156 may also be connected to the fasteners in the top bracket 80.

Figure 9:
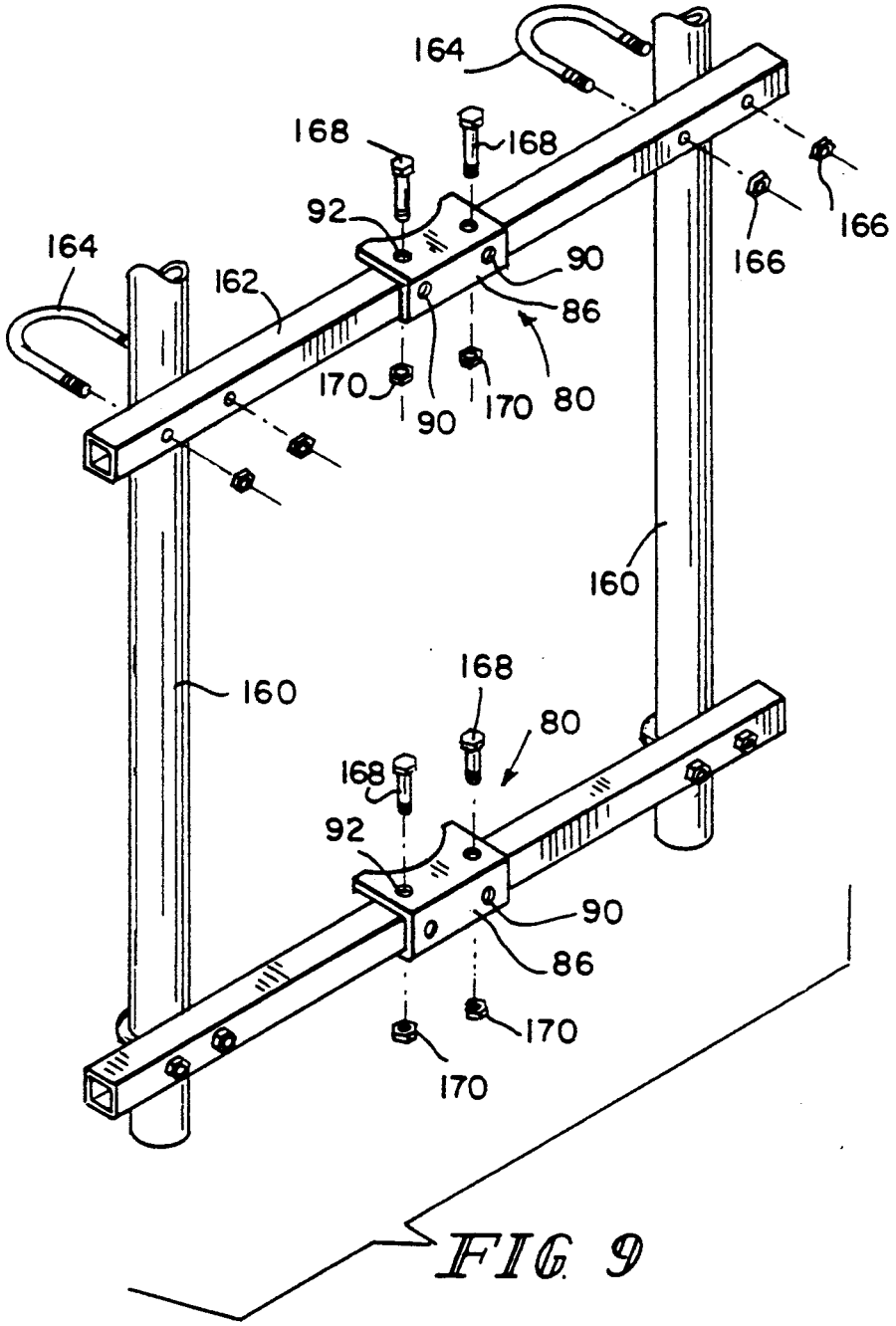
FIG. 9 is a perspective view of the mounting brackets of the present system mounted to a two strut support system.

Although the present system has been designed to be mounted to a single center strut, it may also be mounted to a double support strut as illustrated in FIG. 9. It should be noted that only the support brackets 80 are illustrated in FIG. 9 for sake of clarity. The double struts 160 are suspended from the ceiling and have mounted thereto, by U-bolts 164 and nuts 166, a pair of horizontal bars 166. Apertures are provided in the center horizontal surfaces of the horizontal bars 162. The support brackets 80 slide over the horizontal bars 162 and secured thereto by fasteners 168 extending through apertures 92 in the horizontal walls 84 and secured by nuts 170. Thus it can be seen by providing apertures 90 in the vertical wall 86 and apertures 92 in the horizontal walls 84 of the support brackets 80, the system may be mounted to vertical or horizontal support structures as well as single and double struts.

The present adjustable system may be mounted to any of a variety of structures. The single center strut may include a floor mounted pedestal or even a portable system. Also the single or double vertical tube may be attached to a running track or other cantilevered structure. The system can also be used with wall fold up systems or any other equipment structure. The versatility is produced by the unique bracket structure.

As can be noted in FIG. 3 the cross sections of the guide 82 and the slide 102 are rectangular. This has been found to be particularly beneficial in that it increases the stability of the system during adjustment and has a lower frequency of sticking or rubbing. Although this is illustrated as rectangular, circular or other shapes may be used.

The present adjustable basketball backboard has been designed specifically for a direct mount of the goal to the adjustable backboard structure to alleviate stress in the backboard. It should also be noted that the adjustment structure with the unique support brackets may also be used with under goal mounting wherein the goal would be mounted to the center bracket 94 on the rear wall 96. Accommodations may have to be made for the screw 112. Thus the direct mounting may be not only through the backboard, but also below the backboard.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A direct mount, adjustable basketball backboard and rim structure comprising:

support mounting means for mounting said structure to a support;

guide means connected to said support mounting means;

slide means slidably mounted to said guide means;

backboard mounting means for mounting a backboard to said slide means;

a center bracket connected directly to said slide means, extending substantially the height of said backboard, and having apertures for receiving fasteners to mount said rim; and drive means, covered on at least three sides by said enter bracket, for positioning said slide means along said guide means to adjust the height of said rim.

2. A structure according to claim 1, wherein sad backboard mounting means includes lateral brackets connected to said center bracket and apertures for receiving fasteners to mount said backboard.

3. A structure according to claim 1, wherein said slide mans includes a pair of slides each connected adjacent a respective edge of said center bracket.

4. A structure according to claim 1, wherein said support mounting means includes a support bracket connected to said guide means for receiving a single support strut; and said drive means includes a screw drive having a bolt mounted on said support bracket.

5. A structure according to claim 1, wherein said support mounting means includes a support bracket connected to said guide means, said support bracket having a vertical portion and a horizontal portion, each portion having one or more apertures for receiving fasteners to mount to horizontal and vertical supports.

6. An adjustable basketball backboard and rim structure comprising:

a pair of vertically spaced support brackets for mounting said structure to a support;

guide means connected to and extending between said support brackets;

slide means slidably mounted to said guide means a center bracket extending substantially the height of a backboard and being connected directly to said slide means;

said center bracket including aperture for receiving fasteners to mount a rim to said slide means;

lateral brackets connected to said center bracket for mounting said backboard to said slide means; and drive means covered on at least three sides by said center bracket for positioning said slide means along said guide means to adjust the height of said rim.

7. A structure according to claim 6, wherein said slide means includes a pair of slides each connected adjacent a respective edge of said center bracket.

8. A structure according to claim 6, wherein said guide means includes a pair of guides each connected adjacent a respective edge of said support brackets.

9. A structure according to claim 6, including a rim mounted to said center bracket and extending below said backboard.

10. A structure according to claim 6, including a rim mounted to said center bracket through said backboard.

11. A structure according to claim 6, wherein said support bracket receives a single support strut; and said drive means includes a screw drive having a bolt mounted on said support bracket.

12. A structure according to claim 6, wherein said support bracket having a vertical portion and a horizontal portion, each portion having one or more apertures for receiving fasteners to mount to horizontal and vertical supports.

13. An adjustable basketball backboard and rim structure comprising:

support mounting means including a support bracket for receiving and mounting said structure to a single support strut;

guide means including a pair of guides each connected adjacent a respective edge of said support bracket;

slide means including a pair of slides slidably mounted to said guide mean;

backboard mounting means for mounting a backboard to said slide means;

rim mounting means including a center bracket connected directly to said slide means, extending substantially the height of said backboard and having apertures for receiving fasteners to mount said rim directly to said slide means; and drive means, covered on at lest three sides by said center bracket, for positioning said slide means along said guide means to adjust the height of said rim.

14. A structure according to claim 13 wherein said support mounting means includes a pair of vertically spaced support brackets connected to said pair of guides for receiving a single support strut.

* * * * *

UNITED STATES PATENT AND TRADEMARK OFFICE

CERTIFICATE OF CORRECTION

PATENT NO. : 5,279,496
DATED : January 18, 1994
INVENTOR(S) : Edward Schroeder

It is certified that error appears in the above-indentified patent and that said Letters Patent is hereby corrected as shown below:

In Column 6, line 36, change "enter" to "center";
line 39, change "sad" to "said";
line 44, change "mans" to "means";
line 63, after "means" (second occurrence) insert --;--.

In Column 8, line 18, change "lest" to "least".

Signed and Sealed this

Eighteenth Day of February, 1997

*Attest:*

Bruce Lehman

BRUCE LEHMAN

*Attesting Officer*

*Commissioner of Patents and Trademarks*